US007269902B2

(12) United States Patent
Van Der Meer

(10) Patent No.: US 7,269,902 B2
(45) Date of Patent: Sep. 18, 2007

(54) SHAVING APPARATUS

(75) Inventor: Mattheus Jacobus Van Der Meer, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 28 days.

(21) Appl. No.: 10/539,027

(22) PCT Filed: Nov. 20, 2003

(86) PCT No.: PCT/IB03/05358

§ 371 (c)(1),
(2), (4) Date: Jun. 15, 2005

(87) PCT Pub. No.: WO2004/056539

PCT Pub. Date: Jul. 8, 2004

(65) Prior Publication Data

US 2006/0117569 A1 Jun. 8, 2006

(30) Foreign Application Priority Data

Dec. 19, 2002 (EP) ..... 02080419

(51) Int. Cl.
*B26B 19/14* (2006.01)

(52) U.S. Cl. ..... 30/43.6; 30/346.51

(58) Field of Classification Search ..... 30/43.4, 30/43.5, 43.6, 346.51
See application file for complete search history.

(56) References Cited

U.S. PATENT DOCUMENTS

| | | | | |
|---|---|---|---|---|
| 5,983,501 | A * | 11/1999 | Izumi | 30/43.5 |
| 6,212,776 | B1 * | 4/2001 | Izumi et al. | 30/43.4 |
| 6,901,662 | B1 * | 6/2005 | Steinberg | 30/43.3 |
| 2001/0039734 | A1 * | 11/2001 | Kadijk et al. | 30/43.6 |

FOREIGN PATENT DOCUMENTS

| | | |
|---|---|---|
| EP | 0 925 158 B1 | 6/1999 |

* cited by examiner

*Primary Examiner*—Hwei-Siu Payer
(74) *Attorney, Agent, or Firm*—Adam L. Stroud

(57) ABSTRACT

A shaving apparatus has shaving heads (3) each having an internal cutting member (6) and an associated external cutting member (4); and a drive structure (1) coupled to each of the internal cutting members (6). The external cutting members (4) are each rotatable about an axis of rotation (15) between different shaving positions. The shaving face of each head includes a first shaving field (7) for cutting short hair and a second shaving field (8) for cutting long hair. The shaving fields (7, 8) extend through different segment of the shaving face. For effecting rotation of the external cutting members (4) between the shaving positions, a control member (11) is arranged between the shaving heads (3) and engages the external cutting members (4) of the shaving heads (3) for simultaneously controlling the rotation of the external cutting members (4) of the shaving heads (3).

8 Claims, 5 Drawing Sheets

SHAVING APPARATUS

Figure 1:
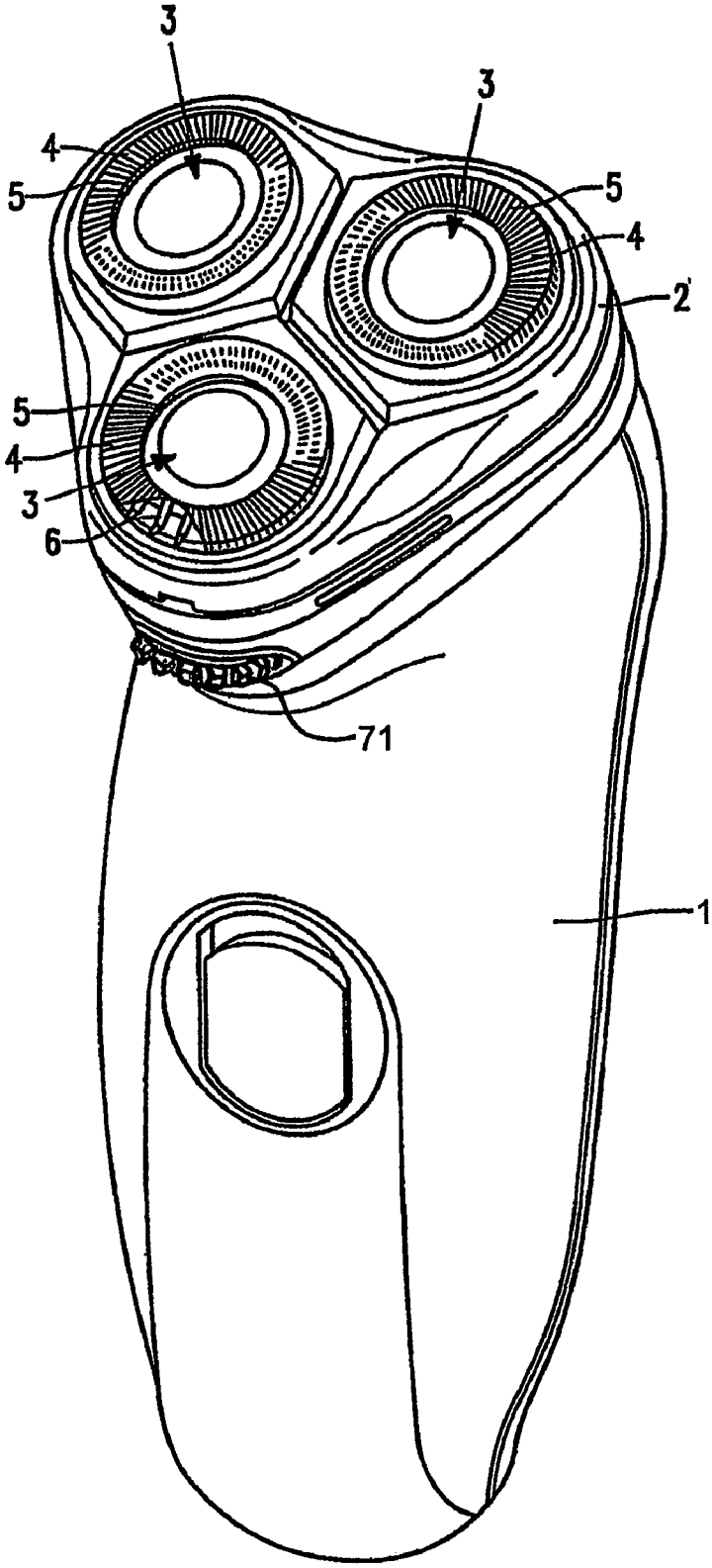

The invention relates to a shaving apparatus.

Such a shaving apparatus is known from European patent specification 0 925 158. Each external cutting member of each shaving head of this shaving apparatus has two shaving fields. One of the shaving fields is particularly suitable for pre-shaving purposes. To this end, it has slit shaped hair-entry apertures for cutting long hairs. The relatively large size of the openings entails that the user's skin tends to bulge through the opening relatively far. To compensate for this effect, which may easily result in skin irritation, the external cutting member is relatively thick in the area of this shaving field. The other shaving field, suitable for final shaving purposes, has small hair-entry apertures for cutting short hairs. The small openings allow relatively little bulging through of the skin and therefore the external shaving member can be very thin for efficiently obtaining a smooth shave without causing skin irritation. Also other differences can be provided between the shaving fields to obtain particular suitability for cutting long or short hair.

In an apparatus with two or more shaving heads, specific rotational orientations with respect to each other of external cutting members with different shaving fields extending through different segments of the shaving faces, can further contribute to convenience of use. For example for a multi-head shaving apparatus it is sometimes convenient that the shaving fields for cutting long hairs are remote from one another and that the shaving fields for cutting short hairs are located close to each other. With such orientations the usual shaving movements over the skin are such that still untreated hairs are reached first by the shaving fields for cutting long hairs and later by the shaving fields for cutting short hairs.

In case of shaving skin areas adjacent to beard edges, however, such orientation of external cutting members could result in the problem that long hairs of the beard are caught by the shaving fields for cutting long hairs and the shaving fields for shaving short hair cannot be brought in contact with the skin areas close to beard edges and areas closely under the nose. This problem is solved by rotating the external cutting members through 180°. However, when using the disclosed apparatus, rotation of the external cutting member involves a number of steps for each shaving head including switching off the apparatus and dismounting and remounting of the external shaving members, which is cumbersome. Furthermore, due to the required removal of the external cutting members, the internal cutting members lie open, which entails injury risks for the user.

The possibility of effecting the 180° rotation by means of some actuating mechanism is mentioned, but this does not provide a simple low-cost solution.

It is an object of the present invention to provide a simple low-cost solution for quickly changing the rotational positions of the rotatable external cutting members of a shaving apparatus.

According to the present invention, this object is achieved by providing a shaving apparatus.

The control member between the shaving heads, forms a simple solution that allows controlling the rotation of the external cutting heads of the shaving heads simultaneously.

Particular embodiments of the invention are set forth in the dependent claims. Further aspects, effects and details of the invention are described with reference to examples shown in the drawings.

Figure 2:
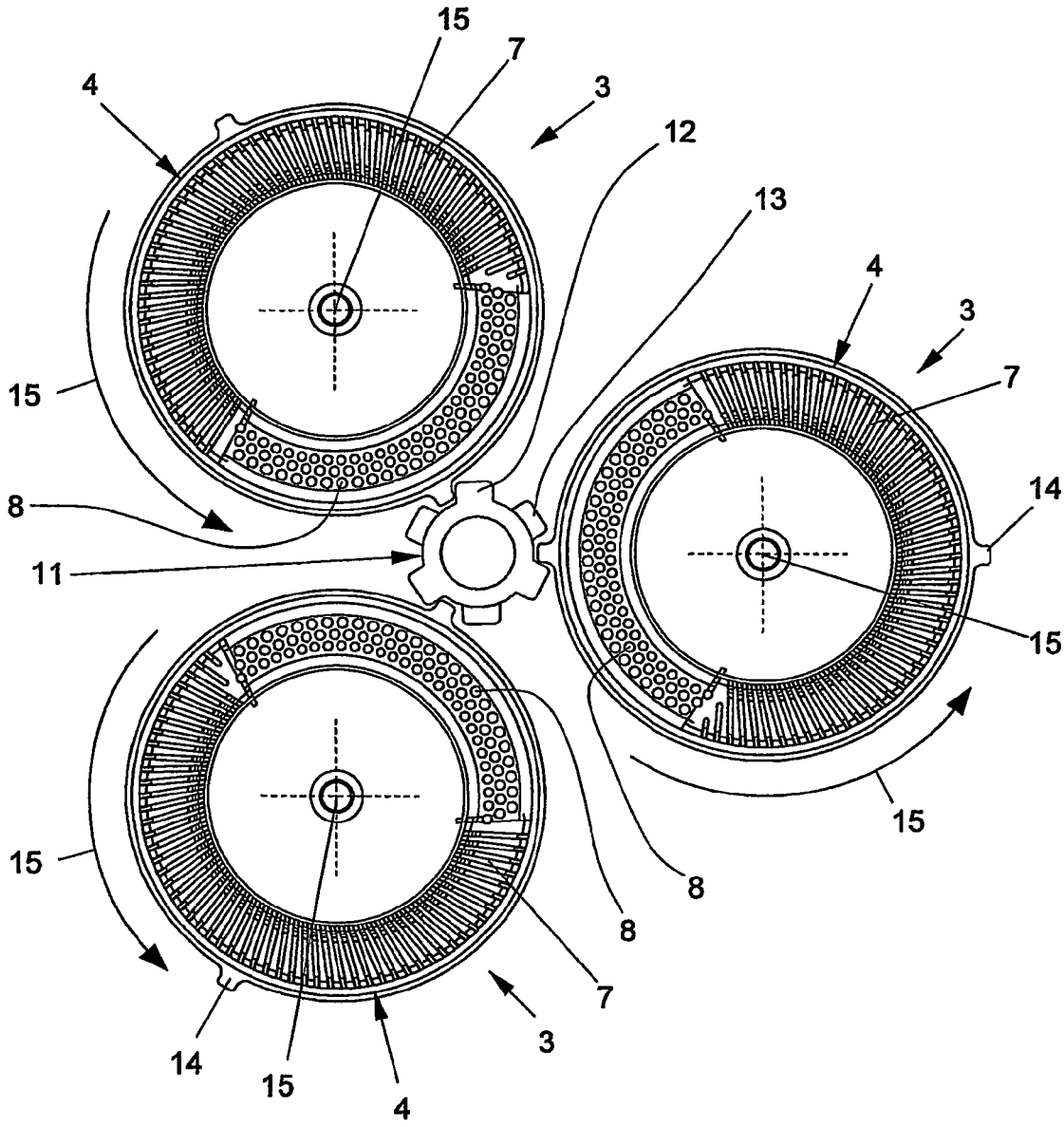
Figure 3:
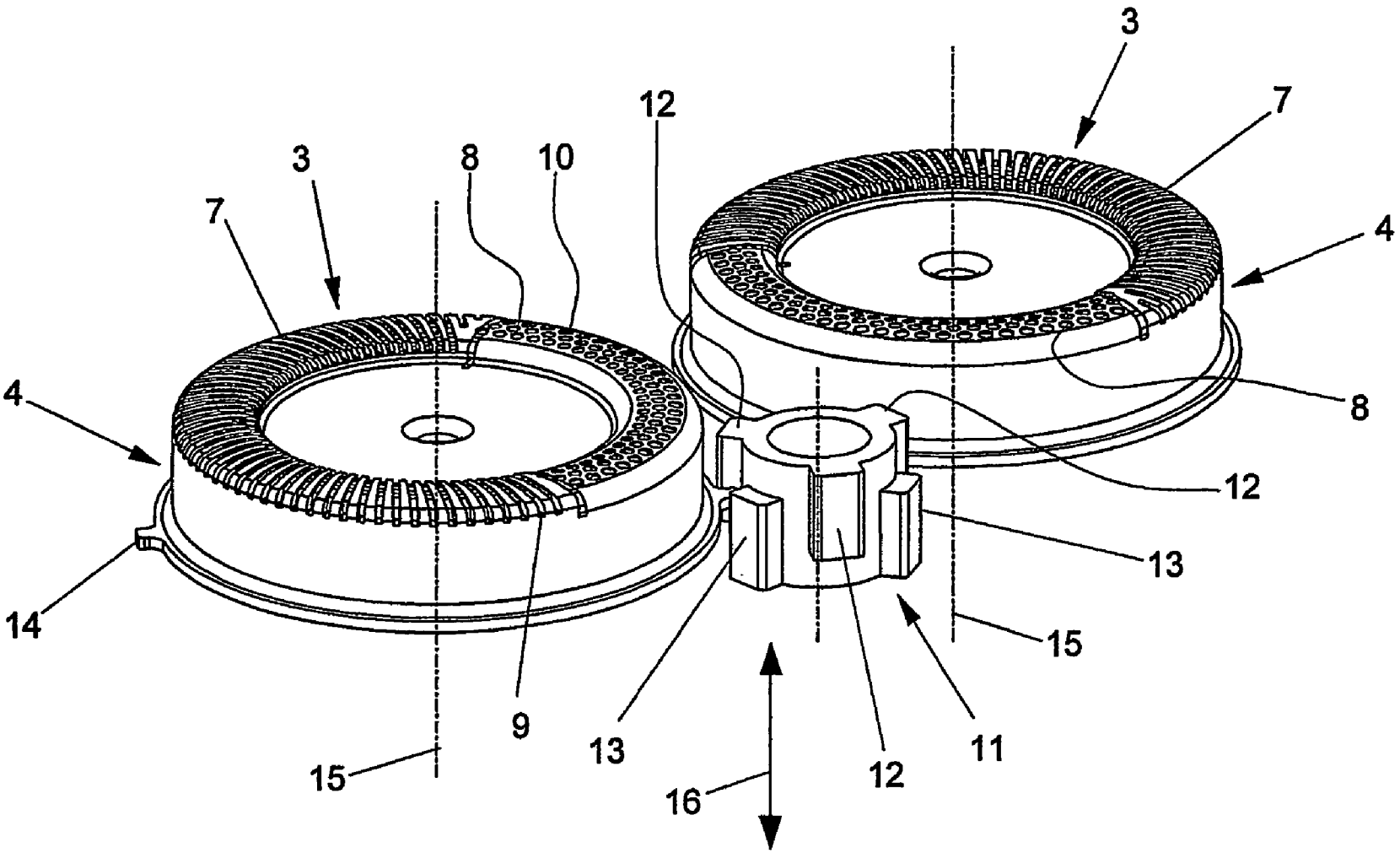
Figure 4:
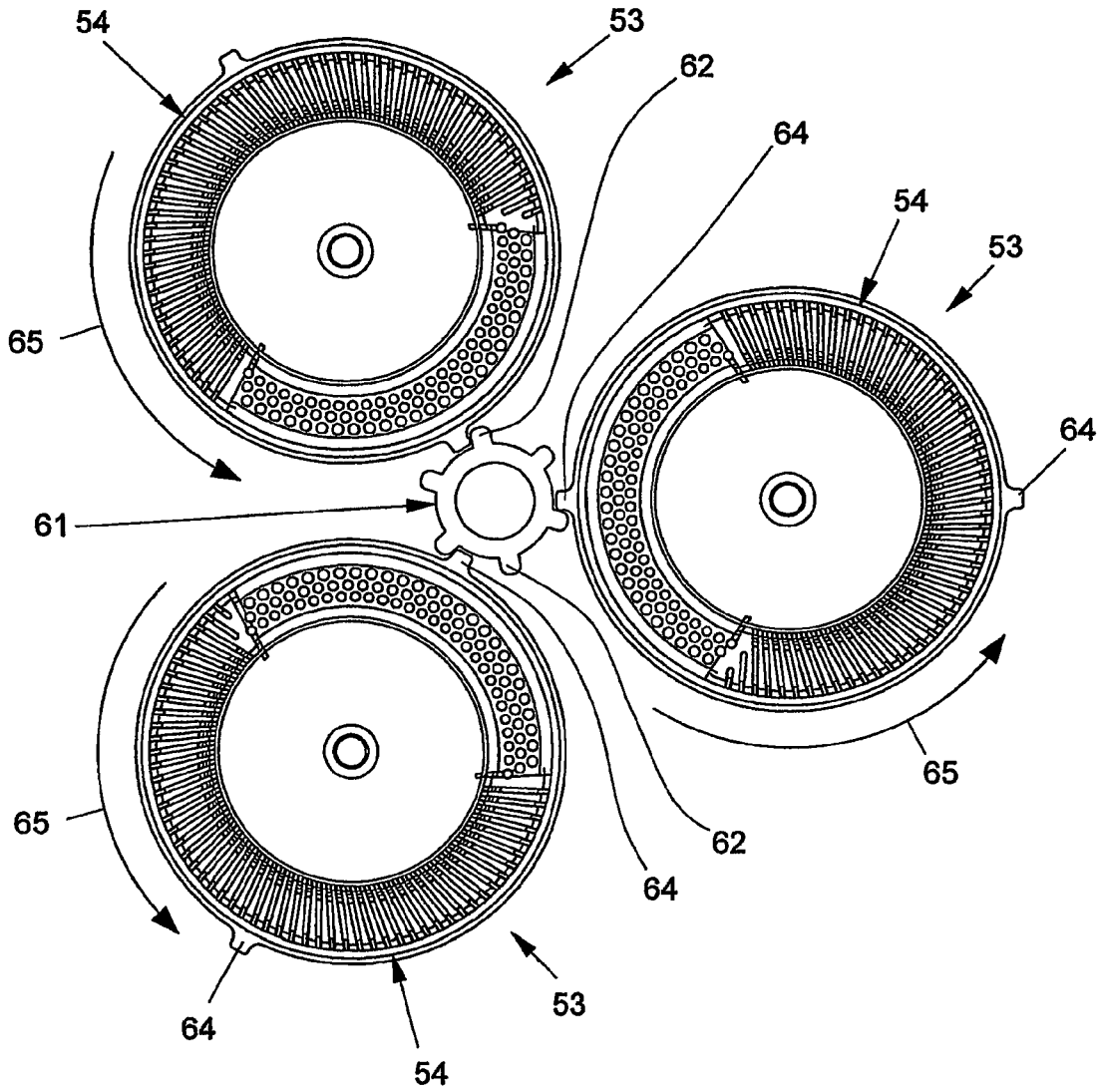
Figure 5:
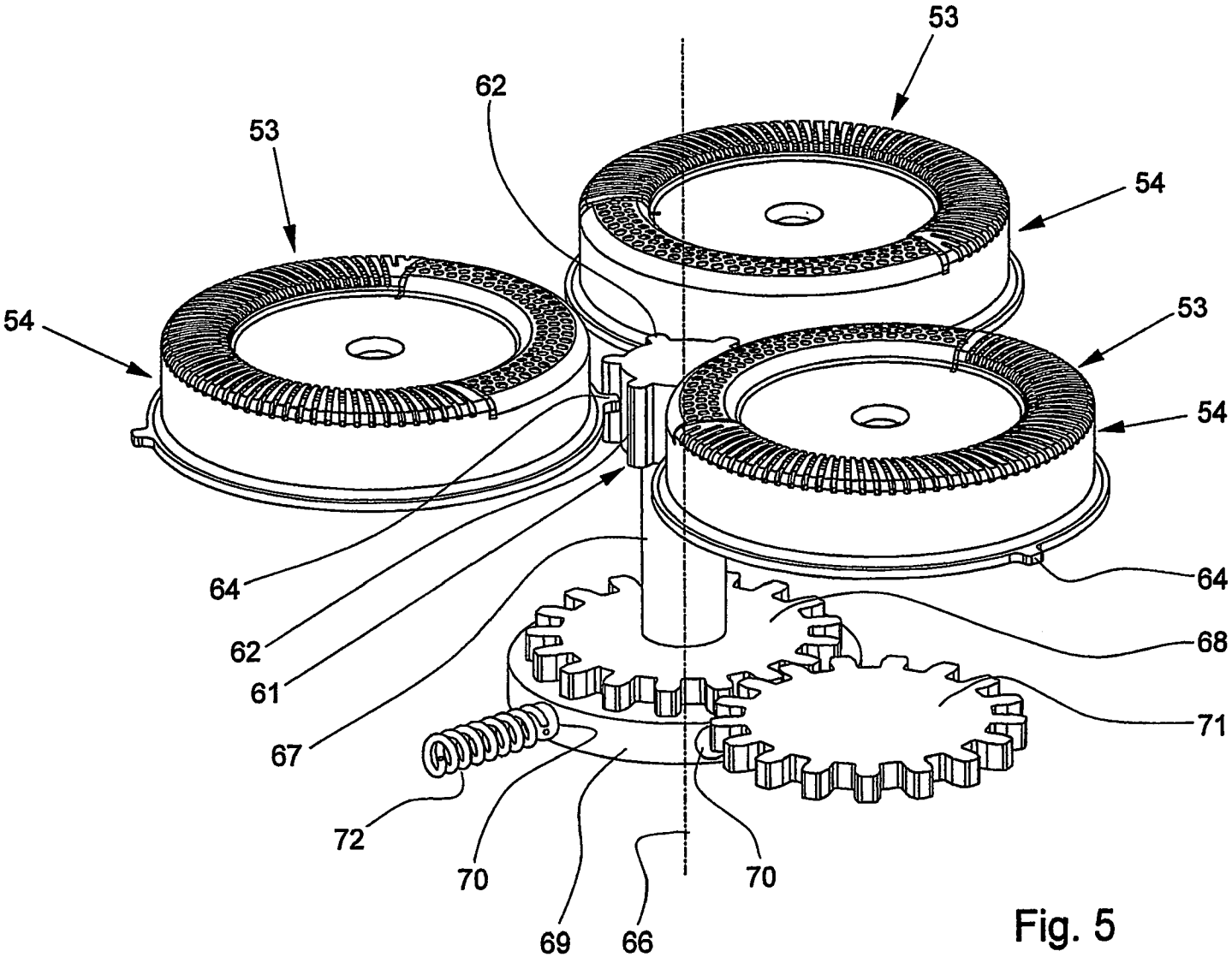

FIG. 1 is a perspective view of a shaving apparatus having three shaving heads, FIG. 2 is a schematic plan view of a first example of a triple-head arrangement of a shaving apparatus, in which the shaving fields with hair-entry apertures for cutting long hairs are remote from one another, FIG. 3 is a perspective view of the example of a triple-head arrangement shown in FIG. 2, in which one of the shaving heads is left out, FIG. 4 is a schematic plan view of a second example of a triple-head arrangement of a shaving apparatus, in which the shaving fields with hair-entry apertures for cutting long hairs are remote from one another, and FIG. 5 is a perspective view of the example of a triple-head arrangement shown in FIG. 4 including an example of a mechanism for actuating the control member.

The rotary shaving apparatus shown in FIG. 1 has a drive unit 1 to which a shaving-head carrier 2 is mounted. In the holder 2 three shaving heads 3, also referred to as cutting units, are mounted, which heads each comprise an external hair-cutting member 4 with hair-entry apertures 5 and an internal hair-cutting member 6 which is coupled to the drive unit 1 for driving rotation of the internal cutting member 6 with respect to the external cutting member 4. Drive units 1 as shown are well known from practice and contain a motor, a transmission for driving stubs removably engaging recesses of the internal cutting member.

The external hair-cutting members 4 of the shaving heads 3 of the shaving head arrangement shown in FIGS. 1-3 each have two shaving fields 7, 8 with different types of hair-entry apertures, i.e. one type with narrow elongate slits 9 that are oriented substantially radially and another type with small, apertures 10 of which lengths and width are substantially equal. According to the present example the narrow apertures are round. However, also other shapes are conceivable. The shaving fields 7 with the slits 9 are particularly suitable for cutting or trimming long hairs, such as hairs that have not been shaved for a day or more, while the shaving fields 8 with the small apertures 10 are particularly suitable for cutting the hairs as closely as possible. The slits 9 are better capable of catching long hairs than the small apertures 8. However, the slits 9 are more likely to cause irritation of the skin than the small apertures 10. Therefore, the thickness of the external hair-cutting member 4 is larger in the area of the slits 9 than in the area of the small apertures 10. Thus, the shaving fields 7 with the slits 9 provide a kind of pre-shave effect and the shaving fields 8 with the small apertures 10 provide a close shave. In FIGS. 1-3 the shaving fields 7 with the slits 9 of the three cutting members, i.e. the fields specialized at catching and trimming long hairs, are remote from one another, while the shaving fields 8 with the small apertures 10, i.e. specialized at severing short baits as closely as possible, are directed towards one another.

By rotating the external cutting members 4 about an axis of rotation 15, the orientation of the shaving fields 7, 8 can be rotated through, according to the present example over 180°, with respect to the orientations shown in FIGS. 1-3. A shaving apparatus with such an orientation of the shaving fields is better suitable for a person who wishes to shave an area adjacent the beard edge. The thumbwheel 71 is an operating member for controlling rotation of the external cutting members 4. An example of the way a thumbwheel 71 as shown can be employed to control rotation of the external cutting members is described with reference to FIGS. 4 and 5.

For effecting the rotation of the external cutting members 4, a control member 11 is arranged between the shaving beads 3. The control member 11 engages the external cutting members 4 of the shaving heads 3 for simultaneously controlling the rotation of the external cutting members 4 of the shaving heads 3. Accordingly, the rotation of the external cutting members is controlled simultaneously by a very simple and compact control member 11.

The control member 11 has restainers 12, 13 projecting from the control member 11 that engage indexing members 14 on the circumference of the external cutting members 4. According to this example, the indexing members 14 are provided in the form of projections, however the indexing members can also be provided in other forms, for instance as recesses or as a stepwise diameter change that forms a shoulder for engaging the restainers 12, 13.

In principle, the rotation of the external cutting members may be driven in various manners, for instance manually by gripping each of the external cutting members and rotating it into the new position determined by the control member engaging the indexing members or by a separate drive structure. According to the present example, the external cutting members 4 are each rotatably suspended such that the friction between the shaving head holder 2 and the external cutting members 4 is lower than the friction between the internal cutting members 6 and the associated external cutting members 4. Accordingly, when and in as far as the indexing members 14 are released by the restrainers 12, 13, the external cutting members 4 are each entrained into rotation by frictional forces exerted by the internal cutting member 6 to which it is associated. Arrows 15 in FIG. 2 indicate the senses of rotation of the internal cutting members 6. When entrained by the internal cutting member 6, the external cutting members 4 also rotate in the sense of rotation indicated by the arrows 15. However, in the operating condition shown in FIG. 3, the external cutting members 4 are each prevented from being entrained by the internal cutting members 6 by one of the restrainers 12, 13, so that the shaving apparatus can be used for shaving in the usual manner.

When it is desired to change the orientation of the external cutting members 4, the control member 11 is actuated for releasing the external cutting members 4 allowing the external cutting members 4 to be entrained by the frictional forces exerted by the rotating internal cutting members 6. Thus, the shaving apparatus does not need to be switched off to change the orientation of the external cutting members 4 and the rotation of the external cutting members 4 is driven by the movement of the internal cutting members 6 relatively to the respective external cutting members 4 in contact therewith. Accordingly, no additional drive means are necessary for driving the rotation of the external cutting members 4 between different shaving positions.

The combination of features according to which each of the external cutting members is suspended for entrainment into the rotation by frictional forces exerted by the internal cutting member to which it is associated, and at least one restrainer is provided for engaging the external cutting members from being entrained by the frictional forces and is actuable for releasing the external cutting members allowing the external cutting members to be entrained by the frictional forces are particulary advantageous in combination with a control members between the shaving heads according to the present invention, because a very simple and compact solution of controlling the movement of the entrained external cutting members is obtained. However, the advantages of allowing rotation of the external cutting member without having to switch off the shaver and driving the rotation without needing additional drive means can also be achieved if this combination of features is applied in a shaver in which the rotation of the external cutting members is controlled by different means, such as for instance restrainers that are part of a control structure that is not located between the shaving heads and/or that do not control the rotation of external cutting members simultaneously.

The two indexing members 14 for engaging the restrainers 12, 13 are circumferentially arranged for engaging one of the restrainers when the external cutting member 4 is in one of the two different positions of rotation about its axis of rotation. According to this example, the positions of the indexing members 14 are on diametrically opposite sides of the circumference of the external cutting members 4, so that after an indexing member 14 is released the cutting member 4 is rotated over about 180° before the other indexing member 14 engages the restrainers 12, 13. However, it is also possible to arrange the indexing members in other positions, for instance if it is desired to provide for other angular differences between the positions of the external cutting members. Furthermore, it is also possible to provide for larger numbers of indexing members if more than two predetermined rotational positions of the external cutting members are desired.

The control member 11 includes, for each cutting member 4, a pair of restrainers 12, 13. One of the restrainers 12, 13 of each pair is positioned for catching another one of the indexing members 14 in response to actuation of the restrainers 13, 12 restraining the cutting member 4 against rotation for releasing the engaged indexing member. If the control member 11 is actuated for causing the restrainers 12, 13 to release the external cutting members 4, after the external cutting member 4has rotated over about 180°, the other restrainer 13, 12 of each pair catches the other indexing member 14 of the external cutting member 4 and prevents it from rotating further. Thus, it is ensured that each time the control member 11 is actuated, the external cutting member 11 can only rotate until the next position determined by the next indexing member 14.

In principle, it can be provided that the restrainer catching the next indexing member is the same restrainer that restrained the released indexing member, for instance by causing the restrainer that has been actuated to release an indexing member 14, to return to its restraining position quickly under influence of spring action.

According to the present example, the other indexing member is caught very reliably because, for catching the other one of the indexing members 14, another restrainer 12, 13 than the restrainer 13, 12 actuated for releasing a restrained one of the indexing members 14 is included. The other restrainer 12, 13 can already be in place for catching the next indexing member 14 at the time the engaged indexing member 14 is released, so that the next indexing member 14 is reliably caught, even if the external indexing member 4 is rotated very quickly.

According to the present example, the control member 11 is moveable for displacing the restrainers 12, 13 in directions 16 parallel to the axes of rotation 15. This allows to displace the restrainers 12, 13 into and out of the path of the indexing members 14 in a simple manner. As is best seen in FIG. 3, the restrainers 12, 13 are arranged in positions staggered in the directions of the axes of rotation 15, lower ones 13 of the restrainers having upward facing ends above the downward facing ends of upper ones 12 of the restrainers, so that the upper and lower restrainers 12 and 13 mutually overlap each other in the directions parallel to the axes of rotation 15.

When the external cutting members 4 are to be rotated, the control member 11 is first moved upwardly (outwardly) from the neutral position shown in FIG. 3, in which each engaged indexing member 14 is held between an upper one and a lower one of the restrainers 12, 13. This movement of the control member 11 causes the upper restrainers 12 to be moved out of the circular path of rotation the indexing members 14, so that each of external cutting members 14 is released and entrained by the associated internal cutting member 6 until the next (in this example the only other) indexing member 14 of each of the external cutting members 4 engages the associated one of the lower restrainers 13. This prevents the external cutting members 4 from being rotated further.

Next, the control member 11 is shifted downwardly (inwardly) through the shown neutral position and into its lowermost position, so that the upper restrainers 12 are moved back into the paths of the indexing members 14 and the lower restrainers 13 are moved out of the paths of the indexing members 14. This causes the indexing members 14 that have just been stopped by the lower restrainers 12 to be released again so that the external cutting members 4 are again entrained by the rotating internal cutting members 6. However, this time the external cutting members 4 are only allowed to rotate over a very small angle, because the indexing members 14 are immediately caught by the associated one of the upper restrainers 12.

Finally, the control member 11 is again shifted back into the shown neutral position so that each external cutting member 4 again has one of its indexing members 14 restrained between an upper one and a lower one of the restrainers 12, 13. However, the external cutting members 4 have now each been brought in a position in which the shaving fields 8 having small openings 10 in a thin wall portion of the cutting member 4 are each located in the portions of the shaving heads 3 located nearest to the outside of the shaving head holder 2, so that a smooth shave can also be achieved along edge portions of the beard to be shaved, such as along the nose and near the ears.

The movement of the control member 11 parallel to the axes of rotation 15 of the external cutting member 4 does not affect the axial movability of the shaving heads or the rotational position of the external cutting members 4. Furthermore, the movement is transverse to the path of the indexing members 14, so that the forces exerted by the internal cutting members have no significant effect on the forces required for actuating of the control member 11.

Because the indexing members 14 are circumferentially spaced such that the external cutting members 4 can be entrained freely between the orientations defined by the positions of the indexing members 14 and the restainers 12, 13, the reorientation of the external cutting members 4 can be carried out very quickly and with a very limited number of members for controlling the rotation of the external cutting members 4.

The axial movement of the control member 11 can for instance be driven by the thumbwheel 71 via a cam surface coupled to the thumbwheel 71.

In FIGS. 4 and 5 an alternative example of a set of shaving heads 53 for a shaver as shown in FIG. 1 is shown. According to this example, the control member 61 is rotatable for actuating the restrainers 62 for releasing the restrained ones of the indexing members 64 of the external cutting members 54. In operation, the indexing members 64 are released by rotating the control member 61. Thus, another simple manner of actuating the control member for releasing the indexing members is provided.

If the control member 61 is actuated while the internal cutting members are being driven and exert frictional forces on the external cutting members 54 in a sense of rotation, such as for instance the sense of rotation indicated by the arrows 65, it is advantageous for ease of operation if the control member 61 is actuated for releasing the indexing members 64 by rotating the control member 61 in a sense of rotation contrary to the sense of rotation of the internal cutting members. This is the sense of rotation in which the control member 61 is driven by the indexing members 64 transferring the torques resulting from the frictional forces exerted by the rotating internal cutting members onto the external cutting members 54. Thus the forces exerted by the indexing members 64 support the actuation of the control member 61 for releasing the indexing members 64.

The other indexing member 64 of each external cutting member may be stopped by the same restrainer 62 that restrained the released indexing member 64, for instance by rotating the control member 61 back. However, for reliably catching the other indexing member 64 of each of the external cutting members 54—thereby preventing that the external cutting members 54 rotate further than over an angle determined by the angle between the released indexing member 64 and the next indexing member 64—preferably another restrainer 62 that is angularly displaced in circumferential sense about the axis of rotation 66 of the control member 61 relative to the restrainer 62 from which the indexing member 64 was released catches the next indexing member. The angle between the successive restrainers 62 and the size of the restrainers 62 is preferably such that the next restrainers is already in position for catching the next indexing member 64 before the restrained indexing member 64 is released by the restrainer 62 restraining that indexing member 64.

For actuating the control member 61, a control shaft 67 extends axially from the control member 61 and is connected to the control member 61 such that, possibly apart from some play, the control member 61 is prevented from rotating relative to the shaft 67. In turn, a gear wheel 68 is connected to the shaft and connected to an indexing disk 69 with indexing protrusions or recesses 70 distributed along its circumference. The gear wheel 68 connected to the shaft 67 is engaged by another gear wheel 71 that projects from the shaving head holder 2 as a thumbwheel (see FIG. 2). For engaging the indexing protrusions or recesses 70, a helical spring 72 is suspended in the housing 1.

In operation, the external cutting members 54 can be switched into the opposite operational orientations by actuating the thumbwheel 71. This causes the gear wheels 71 and 68 to rotate, thereby causing the shaft 67 and the control member 61 to rotate as well. When the control member 61 has rotated so far that the indexing members restrained by the restrainers 62 on the control member 61 are released, the internal cutting members entrain the external cutting members 64. Alternatively, when the apparatus is switched off, the rotation of external cutting members 54 may be driven manually. After the external cutting members 54 have rotated over such an angle that the other indexing member 64 of each of the external cutting members 54 has reached the control member 61, the external cutting members 54 are restrained from rotating further by the restrainers 62 on the control member 61. In the meantime, the thumbwheel 71 can be rotated further until the spring 72 again engages one of the indexing protrusions or recesses 70 and again holds the indexing disk 69 in an orientation corresponding to an orientation of the control member 61 in which the restrainers 62 reliably hold the external cutting members 54 in the selected operational orientations.

Because the operating member 71 that is coupled to the control member 61 is located in a peripheral location relative to the shaving heads, it is located in a position that is not intensively exposed to shaving dust and that can be reached easily while holding the apparatus for shaving.

The invention claimed is:

1. A shaving apparatus comprising:

at least two shaving heads each having an internal cutting member and an associated external cutting member;

a drive structure coupled to each of said internal cutting members for driving movement of each of said internal cutting members relative to the associated external cutting member for cutting off hair from a skin, wherein each of said external cutting members is rotatable about an axis of rotation between at least two shaving positions and comprises a shaving face for contacting the skin, the shaving face extending around said axis of rotation and comprising a first shaving field with apertures of a first type for outing short hair and a second shaving field with apertures of a second type for cutting long hair, the shaving fields of at least said first and second types extending through different segment of said shaving face;

means for effecting rotation of each of said external cutting members between said at least two shaving positions;

characterized in that the means for effecting rotation of the external cutting members include a control member arranged between said at least two shaving heads and engaging said external cutting members of said at least two shaving heads for simultaneously controlling said rotation of the external cutting members of said at least two shaving heads; and wherein each of said external cutting members is suspended for entrainment into said rotation by frictional forces exerted by the internal cutting member of the respective shaving head, the control member including at least one restrainer for engaging said external cutting members from being entrained by said frictional forces and actuable for releasing said external cutting members allowing said external cutting members to be entrained by said frictional forces.

2. A shaving apparatus according to claim 1, wherein the control member is coupled to an operating member in a peripheral location relative to said at least two shaving heads.

3. A shaving apparatus comprising:

at least two shaving heads each having an internal cutting member and an associated external cutting member;

a drive structure coupled to each of said internal cutting members for driving movement of each of said internal cutting members relative to the associated external cutting member for cutting off hair from skin wherein each of said external cutting members is rotatable about an axis of rotation between at least two shaving positions and comprises a shaving face for contacting the skin, the shaving face extending around said axis of rotation and comprising a first shaving field with apertures of a first type for cutting short hair and a second shaving field with apertures of a second type for cutting long hair, the shaving fields of at least said first and second types extending through different segment of said shaving face; and means for effecting rotation of each of said external cutting members between said at least two shaving positions;

characterized in that the means for effecting rotation of the external cutting members include a control member arranged between said at least two shaving heads and engaging said external cutting members of said at least two shaving heads for simultaneously controlling said rotation of the external cutting members of said at least two shaving heads, wherein at least one of the external cutting members includes at least two indexing members for engaging at least one restrainer, said indexing members being positioned on said external cutting members for engaging said at least one restrainer when said external cutting member is in different predetermined positions of rotation about its axis of rotation.

4. A shaving apparatus according to claim 3, wherein said at least one restrainer is positioned for catching another one of said indexing members in response to actuation of said at least one restrainer for releasing a restrained one of said indexing members.

5. A shaving apparatus according to claim 4, wherein said at least one restrainer positioned for catching another one of said indexing members includes another restrainer than the at least one restrainer actuable for releasing a restrained one of said indexing members.

6. A shaving apparatus according to claim 3, wherein said control member is moveable for displacing the at least one restrainer in directions with a component parallel to said axes of rotation.

7. A shaving apparatus according to claim 3, wherein said control member is rotatable for actuating said at least one restrainer for releasing a restrained one of said indexing members, wherein said at least one restrainer includes another restrainer where said at least one restrainer and said another restrainer are angularly displaced to each other in rotational sense of said control member.

8. A shaving apparatus according to claim 3, wherein the control member is coupled to an operating member in a peripheral location relative to said at least two shaving heads.

* * * * *